US005644272A

United States Patent [19]

Dabrowski

[11] Patent Number: 5,644,272

[45] Date of Patent: Jul. 1, 1997

[54] HIGH FREQUENCY BALUN PROVIDED IN A MULTILAYER SUBSTRATE

[75] Inventor: Jerzy Dabrowski, Täby, Sweden

[73] Assignee: Telefonaktiebolaget LM Ericsson, Stockholm, Sweden

[21] Appl. No.: 610,934

[22] Filed: Mar. 5, 1996

[51] Int. Cl.[6] ..... H01P 5/10

[52] U.S. Cl. ..... 333/26; 333/238

[58] Field of Search ..... 333/25, 26, 238, 333/246, 247

[56] References Cited

U.S. PATENT DOCUMENTS

| | | | |
|---|---|---|---|
| 4,016,463 | 4/1977 | Beall et al. . | |
| 4,651,344 | 3/1987 | Hasegawa et al. | 455/325 |
| 4,758,922 | 7/1988 | Ishigaki et al. . | |
| 4,954,790 | 9/1990 | Barber | 332/164 |
| 5,015,972 | 5/1991 | Cygan et al. | 333/26 X |
| 5,025,232 | 6/1991 | Pavio | 333/26 |
| 5,150,088 | 9/1992 | Virga et al. | 333/238 |
| 5,451,914 | 9/1995 | Stengel | 333/25 |

*Primary Examiner*—Paul Gensler

*Attorney, Agent, or Firm*—Burns, Doane, Swecker and Mathis, L.L.P.

[57] ABSTRACT

Baluns according to the present invention use both distributed and discrete elements connected together in a multilayer dielectric structure. As distributed elements, coupled striplines are provided in the multilayer dielectric structure. The discrete components are placed on the surface of the multilayer structure and connected with the distributed elements through via-holes. The operating frequency of the balun can be changed by changing values of the discrete components without changing the multilayer structure itself.

12 Claims, 3 Drawing Sheets

HIGH FREQUENCY BALUN PROVIDED IN A MULTILAYER SUBSTRATE

BACKGROUND

The present invention is generally directed to baluns and, more particularly, to baluns which are implemented as part of a multilayer structure.

A balun (which term comes from the phrase BALanced to UNbalanced) is a passive three port electronic circuit used for conversion between symmetrical and nonsymmetrical transmission lines. The signal, for example incoming to a nonsymmetrical port, is divided between two symmetrical ports providing signals which have the same amplitude but with phases which are 180 degrees offset relative to one another on their outputs. Baluns are used, for example, in the construction of balanced amplifiers, mixers and antenna systems.

The balun construction depends on the intended operating frequency range. In the microwave frequency range, where the size of the structure is comparable to the wavelength of the signal, distributed element circuit technology is commonly used. In lower frequency ranges, e.g., up to 2500 MHz, coupled wire transformer solutions are common in which wires are wound spirally around a highly permeable magnetic core. These conventional balun configurations suffer from a number of problems.

These transformer solutions, using the phenomenon of magnetic coupling between wires, are theoretically wide band circuits. In practice, however, compensation for eigen capacitances is needed, especially in the frequency range 400 to 2500 MHz. This means that the physical construction of the transformer-type baluns has to be specifically optimized for operation within its operating frequency bandwidth. Additionally, it is difficult to accurately set the length of the wires to be wound about the core so that baluns which are designed to be the same, actually have substantially the same electrical characteristics.

Most existing baluns operating in the high (e.g., greater than 2500 MHz) frequency range, give good balun performance only if both symmetrical ports are well matched. In many applications, power matching of the symmetrical ports is not desirable for other reasons. For example, power matching on the symmetrical inputs of mixers or amplifiers worsens their noise parameters. Thus, a compromise between power matching and noise matching is needed.

Moreover, ongoing miniaturization of electronic structures is, in turn, causing the miniaturization of baluns. For example, baluns used in the frequency range 400 to 2000 MHz are not usually bigger than about 20 $mm^2$ and are designed for automatic surface mounting onto the end product. However, during the production of the baluns themselves, manual mounting is still used because the wires require manual winding around the core and the ends of the wires need to be inserted into electrical connectors on the end product. Manual mounting is expensive, time consuming and causes spread in the parameters of the end product, e.g., a radio receiver, of which the balun is just one of many components.

Thus, it would be desirable to provide a balun having better symmetry when working with unmatched loading, which do not require different physical constructions to handle different operating frequency ranges, and which are less expensive to manufacture by allowing automatic integration of the balun with other circuit components as opposed to manual mounting.

SUMMARY

These and other drawbacks and limitations of conventional baluns are overcome according to exemplary embodiments of the present invention. Baluns according to the present invention use both distributed and discrete elements connected together in a multilayer dielectric structure. As distributed elements, coupled striplines are provided in the multilayer dielectric structure. The discrete components are placed on the surface of the multilayer structure and connected with the distributed elements through via-holes. This provides a number of advantageous balun characteristics.

For example, within a range bounded by the characteristics of the dielectric material used in the multilayer structure, the operating frequency range of the balun can be adjusted simply by changing values of the discrete components used to fabricate the balun. In this way, the operating frequency of the balun can be easily changed without necessitating a completely new balun construction. This is a great advantage as compared to, for example, transformer-type baluns for which a completely new construction design was required for different operating frequency ranges.

By fabricating the balun as a multilayer structure, the distributed elements can be provided in a layer which is embedded below that on which the discrete components are mounted. This allows the top layer surface area required for the balun to be reduced which further promotes miniaturization of the products in which the balun is incorporated.

BRIEF DESCRIPTION OF THE DRAWINGS

The foregoing, and other, objects, features and advantages of the present invention will be more readily understood upon reading the following detailed description in conjunction with the drawings in which.

DETAILED DESCRIPTION

Figure 1:
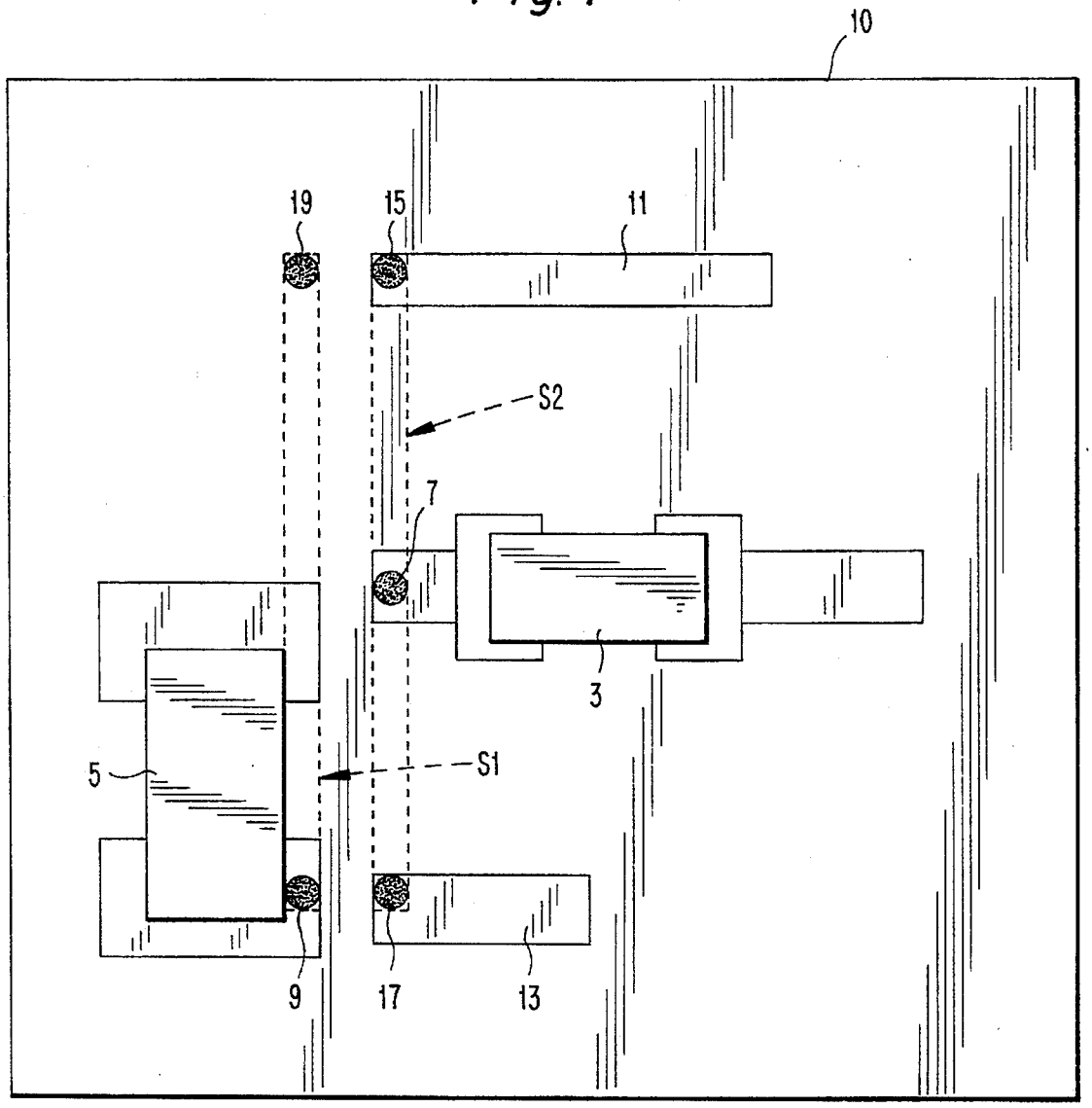
FIG. 1 is a top view of an exemplary multilayer structure in which baluns according to the present invention can be implemented.

An example of a multilayer structure in which baluns according to the present invention can be implemented is shown (in a top view) as FIG. 1. Therein, a coupled pair of striplines S1 and S2 are illustrated as hidden (i.e., by way of the dotted lines) since the coupled striplines are embedded in a lower layer of the multilayer structure 10. A stripline is a well known transmission line which can be formed as a conductive metal trace placed in a dielectric media with two parallel ground planes on both sides of the dielectric surface. A coupled stripline is a structure using two striplines having a constant distance between them. In a multilayer structure, coupled striplines can be made as two parallel traces on the same layer with ground planes on layers above and below the layer with traces, or as parallel traces placed on two adjacent layers. The remaining components illustrated in FIG. 1 are on the surface or top layer of the multilayer structure 10. For example, the multilayer structure 10 could include surface mounted devices 3 and 5. Surface mounted devices 3 and 5 can be electrically connected to the coupled striplines S2 and S1, respectively, using vias (thru holes) 7 and 9, respectively. As is well known in the art, vias are apertures formed in multilayer structures which are plated with conductive material to establish electrical connections at desired points between different layers in the multilayer structure. Additionally, the exemplary multilayer structure 10 shown in FIG. 1 includes microstrips 11 and 13 on the surface or top layer. As is well known in the art, microstrips are controlled impedance microwave frequency transmission lines which are formed as conductive metal traces on one side of a dielectric surface with a ground plane on the other side of the dielectric surface. Microstrips 11 and 13 are connected to one of the coupled striplines S2 by via-holes 15 and 17, respectively. Also illustrated in FIG. 1 is a via 19 which connects the coupled stripline S1 and S2 with a ground plane.

Figure 2:
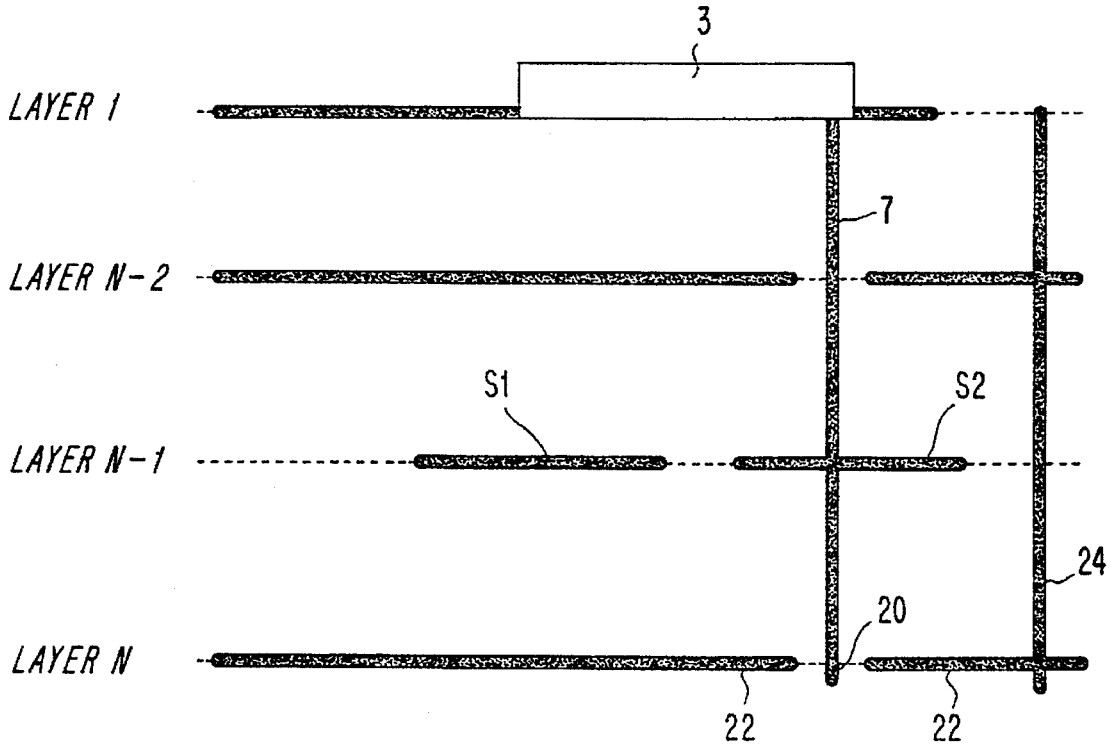
FIG. 2 is a sectional view of an exemplary multilayer structure in which baluns according to the present invention can be implemented.

FIG. 2 illustrates a side view of an exemplary multilayer structure in which baluns according to the present invention can be implemented. Although the side view portrays a slightly different component configuration than the multilayer structure of FIG. 1, similar reference numerals are used to refer to similar elements. For example, the top layer (denoted Layer 1 in FIG. 2) includes a surface mounted device 3. This surface mounted device 3 is connected to one of the coupled striplines S2 which have been fabricated in Layer N-1. In this example, the multilayer structure has four layers, although any number of layers which are equal to or greater than four can be used. The via 7 which interconnects surface mounted device 3 with coupled striplines S1 and S2 is isolated from the ground planes as seen, for example, at point 20 on Layer N which illustrates a separation between the via 7 and the metallized ground plane portions 22. Another conductive via 24 provides a connection between the ground plane Layers N and N-2.

Each of the four conductive layers illustrated in FIG. 2 are separated from adjacent layers by a layer of dielectric material. Moreover, the discrete electrical components provided on Layer 1 of the multilayer structure are electrically isolated from the electrical components provided on Layer N-1, e.g., coupled striplines S1 and S2, by a ground plane provided as Layer N-2. The ground plane can, for example, be a copper layer of about 17.5 mm in thickness. This helps to ensure that the operation of the components provided on Layer 1 is not affected by the provision of electrical impulses to the components on Layer N-1, e.g., by capacitive or inductive coupling effects.

The operating frequency of the balun is bounded by the electrical parameters of the dielectric layers provided in the multilayer structure (e.g., dielectric constant, dielectric losses (loss tangent) and dielectric thickness). For example, if a typical glass-fiber resin material (e.g., having a dielectric constant of 4.25, a loss tangent of 0.02 and a layer thickness of 5 mm) is used for the dielectric layers of FIG. 2, an operating frequency of baluns according to the present invention can be set to be between 100 MHz and 2.5 GHz. The lower value is, in practice, limited by the lengths of the stripline structure. The higher frequency value is limited by losses in dielectric layers and higher wavelength transmission modes which are associated with increasing frequency (given a constant dielectric layer thickness). A significant feature of the present invention is that the operating frequency of the balun may be changed within the bounded range by changing the values of the discrete components, without changing the multilayer structure itself. These and other benefits of baluns according to the present invention will become more apparent after reviewing the detailed description of an exemplary balun circuit configuration provided below.

Figure 3:
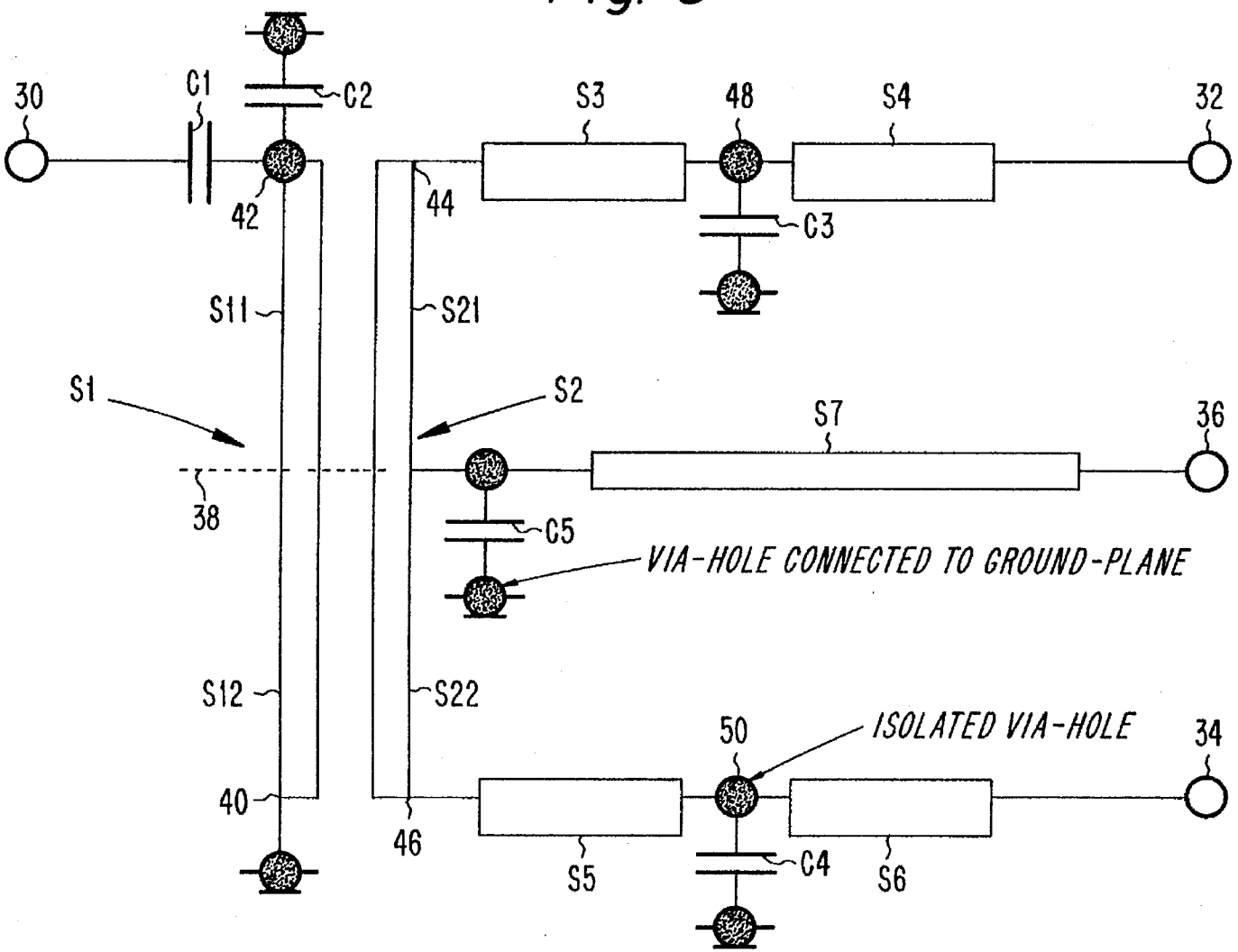
FIG. 3 illustrates an exemplary circuit topology of baluns according to the present invention.

An exemplary balun according to the present invention is shown in FIG. 3. In FIG. 3, vias are depicted using shaded circles. As seen by the examples in this figure, some of the vias are connected to a ground plane (e.g., Layer N-2 and Layer N) while others are connections between the top surface of the multilayer structure and an embedded layer. Port 30 is the nonsymmetrical port of the balun, while ports 32 and 34 are the symmetrical outputs. Thus, ports 32 and 34 each provide an output having the same amplitude, but whose phases differ by 180 degrees (if the balun is perfectly symmetrical). Port 36 is optionally provided (as is transmission line S7) if an external bias is to be connected for biasing ports 32 and 34. Port 36 can be used, for example, to connect active devices (e.g., active amplifiers or active mixers) to bias the symmetrical output ports 32 and 34. Transmission line S7 provides electrical isolation between common node 38 and port 36. When connected to passive devices, port 36 (and transmission line S7) can be omitted.

The distributed element part of the balun includes two sections S 1 and S2 of coupled transmission striplines. Section S1 includes striplines S11 and S12, while section S2 includes striplines S21 and S22. Both sections S1 and S2 can have identical characteristic impedances for even and odd modes and can have identical electrical lengths and be coupled together at common node 38 (represented by a dotted line in FIG. 3). This can be accomplished by making each stripline S11, S12, S21 and S22 of the same length (e.g., 6.4 mm), same width (e.g., 0.2 mm), same thickness and providing a uniform spacing between sections S1 and S2 (e.g., 0.15 mm). Node 40 of stripline S12 is connected to the ground planes and node 42 of stripline S11 is connected to capacitors C1 and C2. The capacitors C1 and C2 have values that are chosen based upon the desired operating frequency of the balun to provide proper matching and impedance transformation for the nonsymmetrical output of the balun. Nodes 44 and 46 of striplines S21 and S22 are connected to striplines S3 and S5 and, together with capacitors C3 and C4, give proper impedance transformation at nodes 48 and 50, respectively. Symmetrical output ports 32 and 34 are connected to nodes 48 and 50 with lines S4 and S6. The proper choice of impedance values and electrical lengths for transmission line elements S3 and S4 and capacitance value of C3 on one side and substantially the same impedance values and electrical lengths for transmission line elements S5 and S6 and capacitance value for C4 on the other side, determines an output impedance of the terminating balun circuit. Those skilled in the art will appreciate that the output impedance can be varied so that the symmetrical ports provide maximal gain (power matching), minimal noise (noise matching) or a compromise between the two competing objectives depending upon the application. The value selected for capacitor C5 gives a proper symmetry of the balun so that the symmetrical outputs have substantially the same amplitude and are as close to 180 degrees offset in phase as possible. This capacitance value depends on the characteristic impedances of the coupled striplines for even and odd modes as well as the electrical lengths of sections S1 and S2 at the operating frequency of the balun. If used, the characteristic impedance and electrical length of transmission line S7 and the impedance in port 36 have to be taken into account to determine the appropriate capacitance value for C5 to maintain the balun symmetry.

As mentioned above, coupled stripline sections S1 and S2 are embedded within a multilayer structure, e.g., structure 10, while the discrete components (e.g., capacitors C1–C5) are provided on Layer 1 or the top surface of the structure. Depending on the design constraints of the balun, striplines (in an embedded layer) or microstrips (on a surface layer) can be used for transmission line elements S3, S4, S5, S6 and S7. In the example shown in FIG. 3, S3 and S5 are fabricated as striplines in an embedded layer (e.g., Layer N-1) along with coupled striplines S1 and S2. Transmission line elements S4 and S6 are fabricated as microstrips on the surface layer along with capacitors C1–C5.

According to exemplary embodiments of the present invention, baluns are constructed in a multilayer structure using distributed and discrete components such that the operating frequency of the balun can be easily adjusted. For example, by adjusting values of capacitors C1–C5, the operating frequency of the balun can be changed within the range dictated by the dielectric media used (e.g., at least within an octave of an originally designed operating frequency between 100 MHz and 2.5 GHz) without changing the multilayer structure or adjusting the coupled striplines which are embedded therein. For example, using the values in Table 1 below, a balun according to the exemplary embodiment of FIG. 3 can operate within the range of 935–960 MHz. By changing the values of capacitors C1–C5 to those shown in Table 2, the same balun structure can instead operate at between 425–430 MHz. Those skilled in the art will appreciate that other capacitance values can be used to achieve other operating frequency ranges.

TABLE 1

| | |
|---|---|
| C1 | 1.8 pF |
| C2 | 0.47 pF |
| C3 | 4.7 pF |
| C4 | 4.7 pF |
| C5 | 3.3 pF |

TABLE 2

| | |
|---|---|
| C1 | 8.2 pF |
| C2 | 12 pF |
| C3 | 27 pF |
| C4 | 27 pF |
| C5 | 33 pF |

The above-described exemplary embodiments are intended to be illustrative in all respects, rather than restrictive, of the present invention. Thus the present invention is capable of many variations in detailed implementation that can be derived from the description contained herein by a person skilled in the art. For example, the nonsymmetrical port can be used as either an input or an output port, while the symmetrical ports can be used as output or input ports, respectively. All such variations and modifications are considered to be within the scope and spirit of the present invention as defined by the following claims.

What is claimed is:

1. A balun comprising:

a nonsymmetrical signal port coupled to a first capacitor, said first capacitor being provided on a top layer of a multilayer structure;

a first ground plane layer provided beneath said top layer;

a coupled pair of stripline elements provided on a third layer beneath said ground plane layer, said coupled pair of stripline transmission elements having a first connection node associated with one of said pair of stripline elements and second and third connection nodes associated with another of said pair of stripline elements, wherein said first capacitor is connected to said first node;

a first symmetrical signal port connected to said second node of said coupled pair of stripline transmission elements, wherein a combination of a first transmission line element, a second capacitor and a second transmission line element are provided between said second node and said first symmetrical signal port; and a second symmetrical signal port connected to said third node of said coupled pair of stripline transmission elements, wherein a combination of a third transmission line element, a third capacitor and a fourth transmission line element are provided between said third node and said second symmetrical signal port;

wherein said second and third capacitors are also provided on said top layer of said multilayer structure.

2. The balun of claim 1, further comprising:

a fourth capacitor, provided on said top layer of said multilayer structure, connected to said first node.

3. The balun of claim 2, wherein capacitance values of said first and fourth capacitors are selected to provide impedance matching and transformation to said nonsymmetrical port.

4. The balun of claim 1, further comprising:

a fifth capacitor connected to a common node which interconnects said coupled pair of stripline elements, said fifth capacitor having a capacitance value selected to maintain outputs of said first and second symmetrical ports at substantially the same amplitude and 180 degrees out of phase with respect to one another.

5. The balun of claim 1, wherein impedance values of said combination of said first transmission line element, said second capacitor and said second transmission line element are selected to provide a desired tradeoff between power matching and noise matching to outputs of said first and second symmetrical ports.

6. The balun of claim 5, wherein said desired tradeoff is optimal noise matching.

7. The balun of claim 5, wherein said desired tradeoff is optimal power matching.

8. The balun of claim 1, further comprising:

a ground plane beneath said layer including said coupled striplines.

9. The balun of claim 1, further comprising:

a biasing port for allowing an external device to bias the first and second symmetrical ports.

10. The balun of claim 1, wherein said first and third transmission line elements are provided on said third layer as striplines and said second and fourth transmission line elements are provided on said top layer as microstrips.

11. The balun of claim 1, wherein said coupled pair of stripline elements have a fourth node which is connected to said ground plane layer.

12. The balun of claim 1, wherein said first, second and third capacitors are also connected to said ground plane layer.

* * * * *